US006877231B2

(12) United States Patent
Rosenberg et al.

(10) Patent No.: US 6,877,231 B2
(45) Date of Patent: Apr. 12, 2005

(54) EXPANDABLE KNIFE HOLDER

(76) Inventors: Gayle Rosenberg, c/o GSL Enterprises, Harmon Cove Towers, Secaucus, NJ (US) 07094; Eli S Pine, 827 Harmon Cove Towers, Secaucus, NJ (US) 07094

( * ) Notice: Subject to any disclaimer, the term of this patent is extended or adjusted under 35 U.S.C. 154(b) by 0 days.

(21) Appl. No.: 10/760,165

(22) Filed: Jan. 20, 2004

(65) Prior Publication Data

US 2004/0148787 A1 Aug. 5, 2004

Related U.S. Application Data

(63) Continuation-in-part of application No. 10/218,147, filed on Aug. 14, 2002, now abandoned.

(51) Int. Cl.[7] ..... A47G 12/14
(52) U.S. Cl. ..... 30/298.4; 248/37.3
(58) Field of Search ..... 248/37.3, 37.6, 248/111, 149, 298.1, 346.3, 27.8, 513; 30/298.5; 211/70.7, 41.5, 41.6, 43, 175; 269/69; 206/344, 379, 315.6, 383, 562, 349, 553; 220/8

(56) References Cited

U.S. PATENT DOCUMENTS 5,192,019 A * 3/1993 Meehan ..... 229/101

* cited by examiner

*Primary Examiner*—Douglas D Watts
(74) *Attorney, Agent, or Firm*—Arnold D. Litt

(57) ABSTRACT

An expandable storage container includes a primary storage container having a series of openings arranged in an upper portion and a cavity on one side, and a secondary storage container arrange at least partially within the primary storage container. The secondary storage container has a series of openings arranged in an upper portion therein, and is sized to be slidably nested within at least a portion of the primary storage container. Items such a knives, rods, screwdrivers, etc. are stored vertically within the openings, and the secondary storage container slides outwardly from the primary storage container to permit additional storage as the use increases the number of item needing storage.

8 Claims, 6 Drawing Sheets

EXPANDABLE KNIFE HOLDER

CROSS-REFERENCE TO RELATED APPLICATIONS

The present patent application is a continuation-in-part of pending U.S. patent application Ser. No. 10/218,147 filed Aug. 14, 2002 now abandoned and entitled "EXPANDABLE KNIFE HOLDER" and which application is incorporated herein in its entirety by reference.

FIELD OF THE INVENTION

The invention relates to the field of expandable storage holders and, more particularly, the invention relates to expandable storage holder for cutlery that provides a means of organizing knives.

BACKGROUND OF THE INVENTION

Most homes have a special set of carving knives that are used to carve foods such as turkey, roast beef, cheeses, etc. A typical set of knives is retained in a wooden holder, which is normally located in the kitchen area on a counter top so as to be readily accessible to the user. The blade of the knives are normally contained within the holder with the handles projecting outwardly so that the user can safely grasp the handle of any particular knife or knives in order to remove the same from the holder.

Typically, with such holders, the knives are oriented at an angle with respect to the normally horizontal counter top, and that angle is determined for the ease of the user and generally can be about 45 degree or steeper angle but may, in some cases, extend vertically upwardly depending upon the particular design of the holder. The angled surface, of course, enables the user to locate the knife holder underneath a cabinet or the like and still be able to readily remove the knives.

Often such knives, particularly carving knives, are relatively expensive, and it is not uncommon for purchases to be made a few at a time until the set is complete.

One problem is that the knife holders are of a fixed size. A typical knife holder is a wooden block with a series of slits made in the top so that the metal part of the knives fit within respective slits. The wooden knife holder is durable and provides a relative safe way to store and handle the knives. The typical knife manufacturer will sell a set of knives with the wooden block having as many slits as there are knives i.e. there are no unused slits available for storing additional knives that are later acquired. Thus, when additional purchases of knives are made, those knives cannot be simply added to the knife holder already owned by the user and normally end up being placed in a cutlery drawer, away from the knives in the holder, and therefore not available to the user in a well organized manner.

Accordingly, it would be advantageous to have a knife holder that could be expanded in accordance with the acquisition of additional knives by a user, that is, to have a knife holder that can have an initial capacity for knives but that can be expanded to accept additional knives incrementally with ease and convenience to the user.

SUMMARY OF THE INVENTION

The present invention provides an expandable storage holder for an implement, such as a knife. The description herein will be directed to the use of the present invention as applicable to knives and the storage thereof, however, it will be seen that the present storage holder is also useful for the storage of other implements as well, such as lawn equipment, tools or any other implement that requires some storage holder where the ability to expand the storage holder is advantageous.

According to an aspect of the invention, the expandable knife holder is incrementally expandable so that one can increase the amount of knives that it holds by a few at a time making for neater and more aesthetically looking storage.

According to an aspect of the invention, the expandable knife holder comprises a primary storage container that has at least two spaced apart surfaces having a plurality of aligned openings, that is, the surfaces may be provided by separate partitions in the knife holder or may be the opposed external surfaces of a solid block of material. The presence of the spaced apart surfaces with openings provides stability to the knives stored therein since the knives are thereby held at two supporting locations that are spaced apart.

There is also a secondary storage container that also has at least two spaced apart surfaces with each of those surfaces having a plurality of aligned openings and, again, the use of the spaced apart surface with openings provides a stable storage place for the knives when located in the knife holder.

As a note, therefore, the openings for knives are thin, elongated openings, however, for other implements, the openings may be other configurations in order to accommodate the particular shape of the implement being stored.

The second storage container is movably received within the primary storage container such that it can be slid from a position where it is substantially nested within the primary storage container to a position where the secondary storage container is partially or fully withdrawn from the primary storage container so as to extend outwardly therefrom.

That sliding motion can take place horizontally, vertically or even may be a rotational motion. Once withdrawn, to whatever extent, the second storage container provides additional sites for storing the particular knives such that the knives can be stored in both the primary storage container as well as the extended secondary storage container and, in either case, the knives still pass through openings in at least two spaced apart surfaces so that the knives are retained in a stable environment in either the primary storage container or the secondary storage container that has been moved outwardly from its nested position within the primary storage container to an extended position.

While the embodiment shown relates to the use of a primary and secondary storage containers, it can also be readily seen that there may be a tertiary storage container nested, for example, within either the primary or secondary storage containers and provide yet additional storage capacity for the present expandable storage holder.

DETAILED DESCRIPTION OF THE INVENTION

Figure 1:
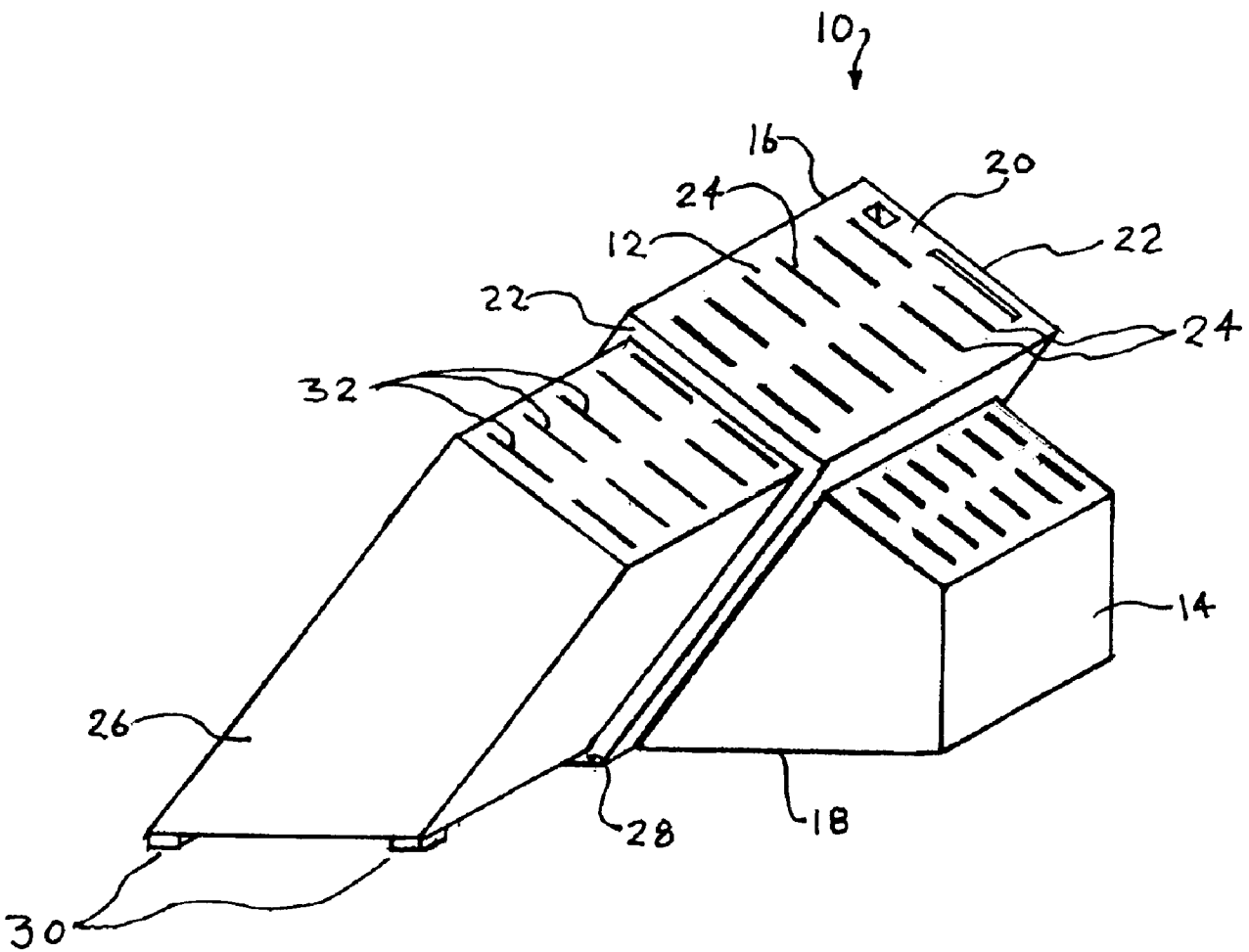
FIG. 1 illustrates a perspective view of the expandable knife holder of the present invention.

FIG. 1 shows one aspect of the present invention. It is to be understood by persons of ordinary skill in the art that the drawings are provided for purposes of illustration not for limitation and the number, size, depth, thickness or orientation of the slots can be arranged differently than shown.

As such, in FIG. 1, there is shown a perspective view of an expandable knife holder 10 that includes a primary storage container 12. The primary storage container 12 has a front 14, a rear 16, bottom 18, top 20 and lateral sides 22. The bottom is, of course, adapted to rest on a supporting surface that is generally horizontal, such as the counter top in a kitchen. The top 20 can, therefore, but not necessarily, be angled at an angle from about 20 to about 50 degrees, preferably about 45 degrees, with respect to the generally horizontal bottom 18 in order to facilitate the insertion and removal of the knives where the vertical space above the knife holder 10 is limited, such as beneath an overhanging cabinet.

There are also a plurality of openings 24 formed in the top 20 and, as shown, are elongated, narrow openings 24 so as to comfortably interfit with and receive knives to be inserted therein, however, as explained, the actual shape of the openings 24 may vary depending upon the particular implements to be stored therein.

In the embodiment shown, the top 20 is shown as a two tiered top, however, only one tier can be used consistent with the present invention. The height of the primary storage container 12 is preferable chosen according to the length of the longest knife blade that will be used, so that only the knife handles will be exposed.

A secondary storage container 26 is shown and which is smaller in size than the primary storage container 12, so that the secondary storage container 26 can be arranged to fit or nest in a snug fashion at least partially within the primary storage container 12. In one embodiment, the secondary storage container 26 is sized to fit completely within the primary storage container 12.

The secondary storage container 26 is shown having been moved outwardly from a hollowed out cavity 28 formed in the primary storage container 12 to allow expansion by successive increments. Thus, the secondary container 26 can be slidably interfitted within the cavity 28 either entirely or partially and be moved or extended outwardly to the position as shown depending upon the need for additional capacity for knives to be stored in the knife holder 10.

In the embodiment of FIG. 1, the cavity 28 is located in one of the lateral sides 22 of the primary storage container 12 and the secondary container 26 is horizontally slidable. A pair of feet 30 are located at the distal end of the secondary storage container 26 so that the movement of the secondary storage container 26 remains level and, once the secondary storage container 26 has been extended to its desired location, the feet 30 retain a level orientation of the secondary storage container 26. As also can be see, there are also an aligned plurality of secondary openings 32 in the secondary storage container 26 that can be used for the storage of knives.

In this particular case, as there are two rows of openings 24 and secondary openings 32, the secondary storage container 26 can be pulled away from the primary storage container 12 to permit two additional secondary openings 32, four additional secondary openings 32, six additional secondary openings 32 etc. For example, if the knife holder 10 has three rows of openings, the storage would expand by three, six, nine, or twelve addition openings, depending on how far the secondary storage container 26 was separated from the primary storage container 12.

The secondary openings 32 in the secondary storage container 26 are spaced at intervals that are in alignment with the openings 24 in the primary storage container 12 so that when the secondary storage container 26 is at least partially nested within the primary storage container 12, the overlapping openings 24 and secondary opening 32 are in alignment to permit placement of the knife blades.

Figure 2:
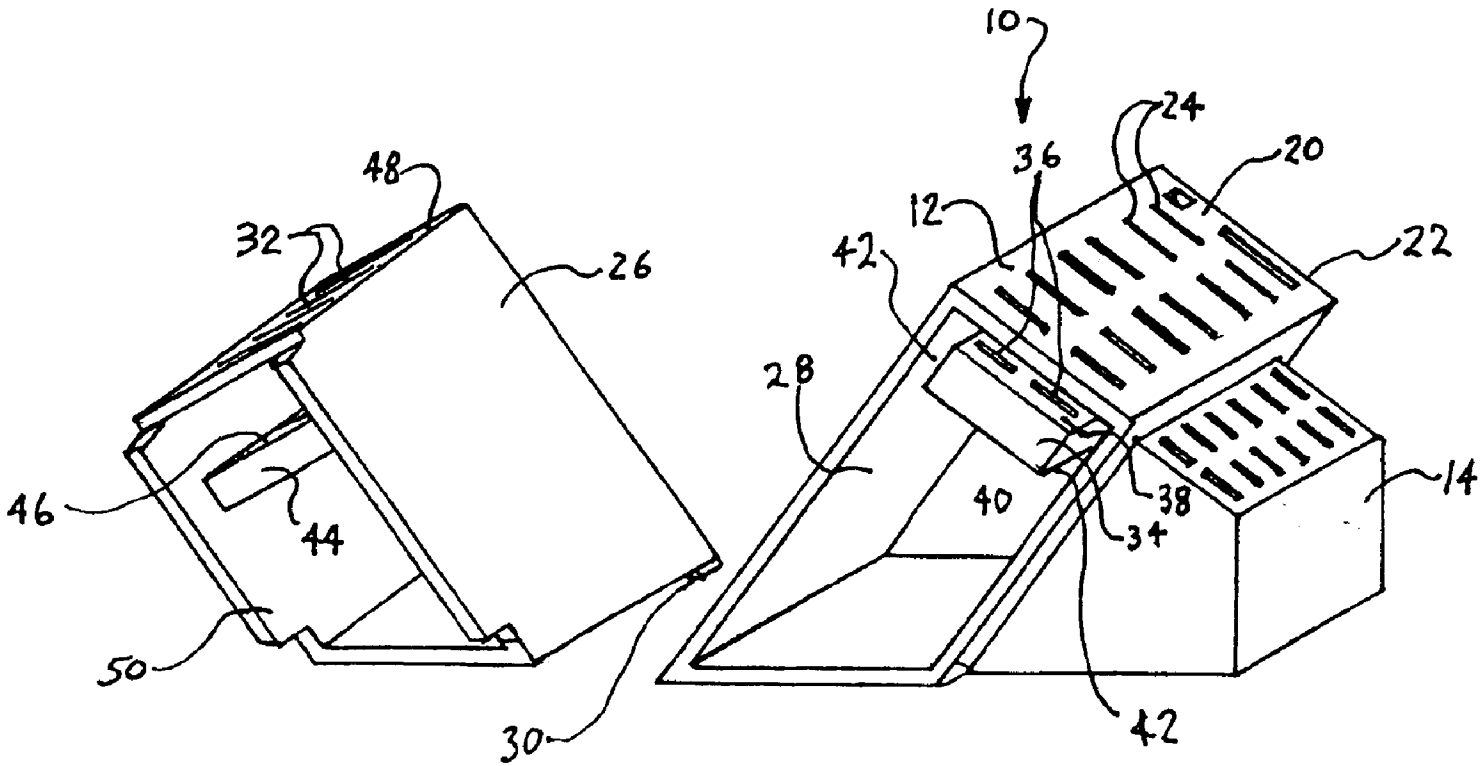
FIG. 2 is an exploded view of the expandable knife holder of FIG. 1 and showing the interior area of the primary storage container.

Turning now to FIG. 2, there is an exploded view of the present knife holder 10 and wherein FIG. 2 shows the internal area of the primary storage container 12 and the secondary storage container 26 entirely apart from each other. Again, it is emphasized that the number and size of openings can be varied according to need, and the primary storage container could have 10, 20, or as many openings 24 slots as desired.

The number of rows can be varied according to need as well (although two rows are shown, the number of rows is limited only by the size that one wants the knife holder to occupy, and these features are clearly within the spirit of the invention and the scope of the appended claims).

As also can be seen in FIG. 2, there is a primary partition 34 that is located within the primary storage container 12 and which has lower openings 36 formed therein that are oriented so as to be in alignment with the openings 24 in the top 20 of the primary storage container 12. The primary partition 34 is mounted to the far, lateral side 22 of the primary storage container 12 so that there is an upper space 38, lower space 40 and side spaces 42 surrounding the primary partition 34.

Likewise, there is a secondary partition 44 located within the secondary storage container 26 and which also has a plurality of secondary lower openings 46 formed therein that are in alignment with the secondary openings 32 in the secondary storage container 26.

Accordingly, when the secondary storage container 26 is assembled to be nested within the primary storage container 12, the top 48 of the second storage container 26 will interfit into the upper space 38 of the primary storage container 12, the secondary partition 44 will interfit into the lower space 40 and the lateral sides 50 of the secondary storage container 26 will interfit into the side spaces 42 of the primary storage container 12.

As can there now be seen and appreciated, when the secondary storage container 26 is nested or partially nested within the primary storage container 12, the knives can pass through at least two openings, that is, the knives will pass through at least the openings 24 and the lower openings 36 in the primary storage container 12 or the secondary openings 32 and secondary lower opening 46 in the secondary storage container 26 so that the knives are stabilized and do not wobble back and forth while being stored.

Of course, where the primary storage container 12 and secondary storage container 26 overlap due to the nesting therebeteween, the knives will actually pass through four openings, that is, the openings 24, the lower openings 36, the secondary openings 32 and the secondary lower openings 46, however, the important feature is that the knives pass through at least two openings, spaced apart, so that the knives are maintained in a stable environment.

It can be seen that the secondary storage container 26 is telescoped within in the primary storage container 12 such that the orientation of the larger openings of the second storage container will always progress outwardly beneath any smaller openings in the primary storage container such that a knife will always fit through an aligned opening in the secondary storage container if the knife passes through an opening in the primary storage container.

Figure 3:
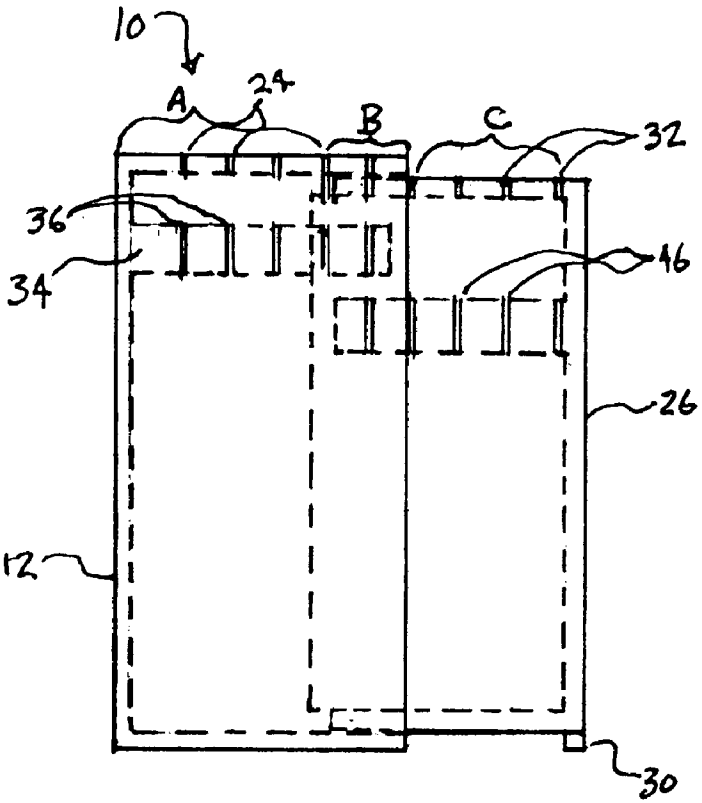
FIG. 3 is a side, cross sectional view of the expandable knife holder with the secondary storage container in a partially extended position.

FIG. 3 shows a side cross-sectional view showing the alignment and the orientation of the various openings in the primary and secondary storage containers 12, 26 of the present invention. As such, the knives will pass through the openings 24 and lower openings 36 within the area designated as A; through four openings, that is, the openings 24, lower openings 36, secondary openings 32 and secondary lower openings 46 in the overlapping area designated as B and through the secondary openings and secondary lower openings 46 of the secondary storage container 26 in the area designated as C. In all cases, however, the knives will pass through at least two spaced apart openings.

The spaced apart openings have been accomplished in the primary storage container 12 by means of the primary partition 34, however it can be seen that the spaced apart openings 24, 36 can be formed in a solid block of material with the respective spaced apart openings formed in the opposite surfaces of the solid block of material such the there is no space or void as seen in FIG. 3 between the openings 24 and lower openings 36 by the spaced apart orientation of the primary partition 34.

Figure 4:
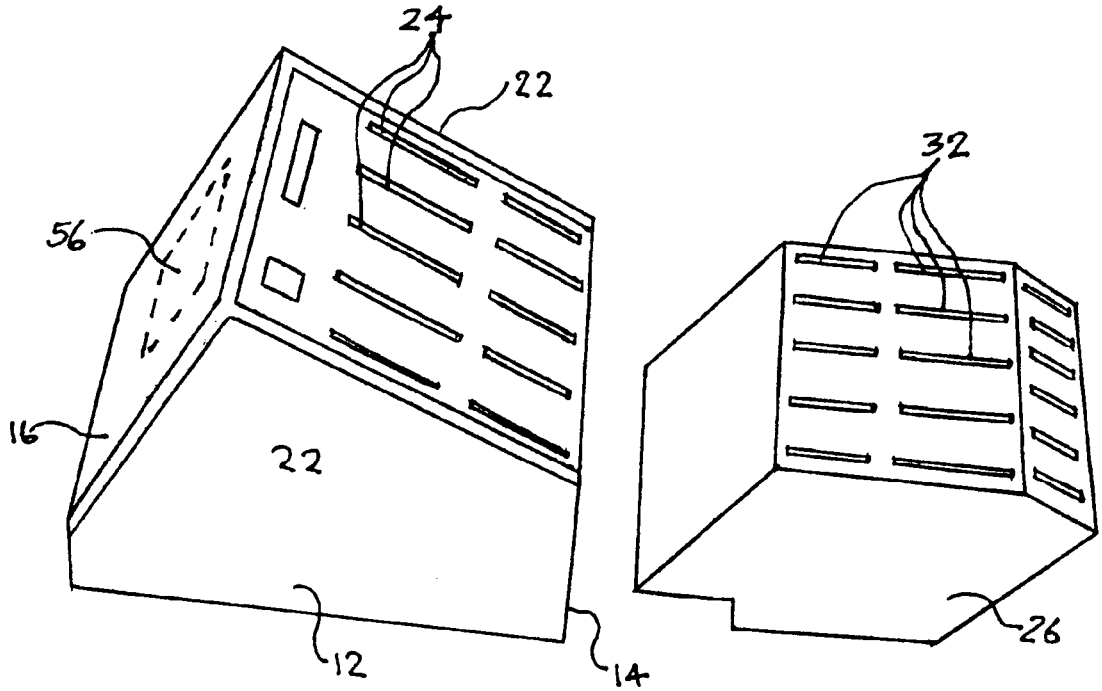
FIG. 4 is a perspective view of a further embodiment of the present invention.
Figure 5:
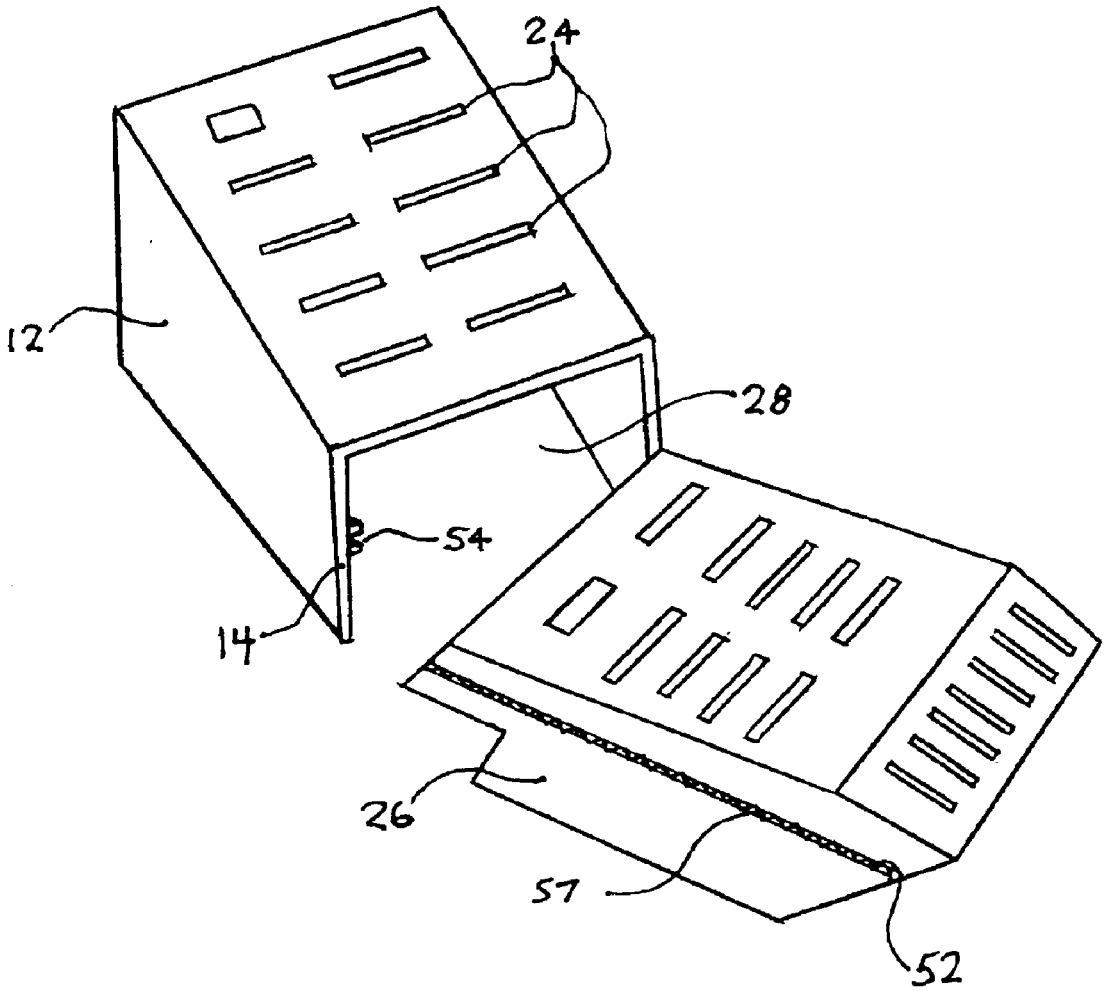
FIG. 5 is an exploded view of the FIG. 4 embodiment.

Turning now to FIGS. 4 and 5, there is a perspective and an exploded view of an alternative embodiment of the present invention and where the primary storage container 12 has the cavity 28 for receiving and nesting the secondary storage container 26 located in the front 14 instead of the lateral sides as in the FIG. 1–3 embodiment.

In this embodiment, there is also shown a groove 52 formed in the secondary storage container 26 that interfits with a ridge 54, or series of ridges and grooves, that facilitate the sliding action between the secondary storage container 26 and the primary storage container since the ridge/groove interfit with each other and stabilize that sliding movement. The ridge and groove can, of course, be reversed, that is, the ridge can be on the secondary storage container 26 and the grove formed on the primary storage container 12.

As can also be seen in FIG. 5, the groove 52 and the ridge 54 can have a plurality of serrations 55 formed therein so that the secondary storage container 26 can be moved relative to the primary storage container 12 in a plurality of spaced apart intervals or discrete positions as it is moved to its desired extended or partially extended position.

In addition, a counterweight 56 can be attached to the rear 16 of at least the primary storage container to prevent it from turning over.

Figure 6:
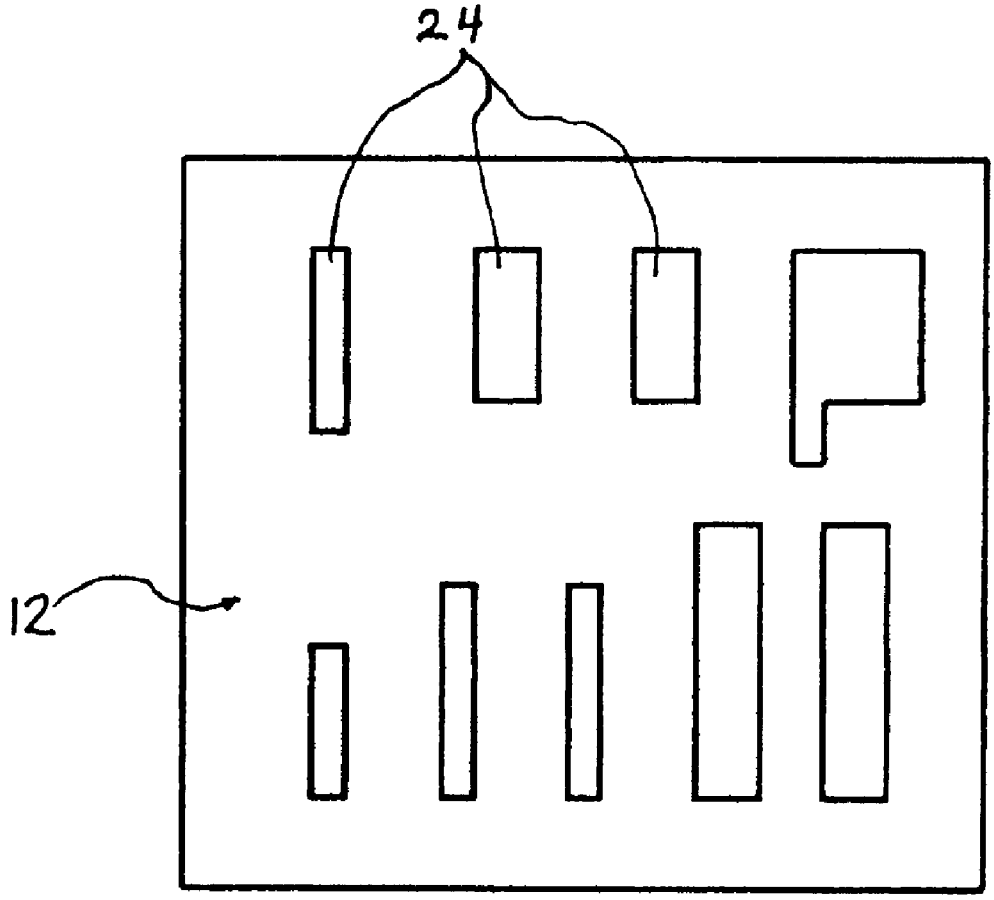
FIG. 6 is a top view of one configuration of the upper surface of a storage container.

FIG. 6 is a top plan view of one design of a knife holder face showing the various configurations of openings 24 that can be made therein. As stated, while the configuration of FIG. 6 is suitable for knives, with other implements, there may be specially designed openings so as to receive any variety of different cross section implements.

In addition, particularly, if the knife holder is made of material other than wood (e.g., plastic) a series of teeth 57 on a track can be arranged inside the primary storage container and or arranged on a portion of the secondary portion, so that the teeth 57 mesh when the containers are pushed together or pulled apart. The track can be designed such that it facilitates expansion of the knife holder to a two position expansion, four position expansion, six position expansion, etc.

In addition, while the embodiments shown teach that the knife holder is expandable in a longitudinal (horizontal) direction, it should be understood that the expansion could occur in a vertical direction. Moreover, the secondary storage container could be rotatable within the primary storage container with the storage container either being partly curved or circular in shape.

The container could be locked into placed, for example, by a bias element or pin. This item would facilitate vertical expansion where the primary and secondary containers could have a series of aligned holes, and the pin, clip or bias holds the secondary storage container in a certain predetermined position extending from the primary storage container.

Also, while there is shown a primary and a secondary storage container, the invention could have a third, fourth, fifth or as many extensions as desired, all of which telescopically extend, with each extension being slightly smaller in overall size.

Finally while the present invention has been shown as a knife holder, it should be understood that the invention could be used with any item that can be vertically stored, such as tools (for example, a series of screw drivers in an expandable storage box) scissors, pliers, wrenches. The slots would be sized accordingly, depending on the item to be stored. In fact, the slots could be circular holes to permit storage of small jars containing hardware, spices, paints, etc. Also, while the knife holder is shown as being inclined, that particular feature is not an absolute requirement, and the holder could be designed without an inclination, or an inclination at the sides etc. In one embodiment, a counterweight can be attached to the rear of at least the primary storage container to prevent it from turning over.

What is claimed is:

1. An expandable storage holder for storing implements inserted therein, comprising:

a primary storage container having at least two spaced apart surfaces, each of said surfaces having a plurality of aligned openings formed therein, a secondary storage container having at least two spaced apart surfaces, each of said surfaces having a plurality of aligned openings formed therein, said secondary storage container being movably received within said primary storage container between a nested position wherein said secondary storage container is at least substantially located within said primary storage container and an extended position wherein said secondary storage container extends outwardly from said primary storage container, said openings in said at least two surfaces of said primary storage container and said at least two surfaces of said secondary storage container being oriented such that an implement inserted into said expandable storage holder passes through at least two spaced apart openings, wherein said secondary storage container includes legs that allow said secondary storage container to be moved outwardly from said primary storage container along a generally horizontal plane, wherein said primary storage container has a front, rear and lateral sides and wherein said secondary storage container extends out from one of said lateral sides of the primary storage container in a horizontal direction.

2. An expandable storage holder for storing implements inserted therein, comprising:

a primary storage container having at least two spaced apart surfaces, each of said surfaces having a plurality of aligned openings formed therein, a secondary storage container having at least two spaced apart surfaces, each of said surfaces having a plurality of aligned openings formed therein, said secondary storage container being movably received within said primary storage container between a nested position wherein said secondary storage container is at least substantially located within said primary storage container and an extended position wherein said secondary storage container extends outwardly from said primary storage container, said openings in said at least two surfaces of said primary storage container and said at least two surfaces of said secondary storage container being oriented such that an implement inserted into said expandable storage holder passes through at least two spaced apart openings, wherein at least one surface of said secondary storage container has an interlocking structure that is guided by a mating interlocking structure on said primary storage container.

3. An expandable storage holder for storing implements inserted therein, comprising:

a primary storage container having at least two spaced apart surfaces, each of said surfaces having a plurality of aligned openings formed therein, a secondary storage container having at least two spaced apart surfaces, each of said surfaces having a plurality of aligned openings formed therein, said secondary storage container being movably received within said primary storage container between a nested position wherein said secondary storage container is at least substantially located within said primary storage container and an extended position wherein said secondary storage container extends outwardly from said primary storage container, said openings in said at least two surfaces of said primary storage container and said at least two surfaces of said secondary storage container being oriented such that an implement inserted into said expandable storage holder passes through at least two spaced apart openings, wherein said interlocking structure on said second storage container comprises a groove to facilitate the sliding of the secondary storage container within the primary storage container, wherein the secondary storage container includes at least one ridge aligned to fit within a groove of the primary storage container, wherein said interlocking structure includes serrations to provide a plurality of discrete positions of movement of said secondary storage container with respect to said primary storage container, wherein at least one surface of said secondary storage container has an interlocking structure that is guided by a mating interlocking structure on said primary storage container.

4. The expandable storage holder according to claim 2 wherein the secondary storage container includes at least one ridge aligned to fit within a grove of the primary storage container.

5. The expandable storage holder according to claim 2 wherein said interlocking structure includes serrations to provide a plurality of discrete positions of movement of said secondary storage container with respect to said primary storage container.

6. An expandable storage holder for storing implements inserted therein, comprising:

a primary storage container having at least two spaced apart surfaces, each of said surfaces having a plurality of aligned openings formed therein, a secondary storage container having at least two spaced apart surfaces, each of said surfaces having a plurality of aligned openings formed therein, said secondary storage container being movably received within said primary storage container between a nested position wherein said secondary storage container is at least substantially located within said primary storage container and an extended position wherein said secondary storage container extends outwardly from said primary storage container, said openings in said at least two surfaces of said primary storage container and said at least two surfaces of said secondary storage container being oriented such that an implement inserted into said expandable storage holder passes through at least two spaced apart openings, further comprising a tertiary storage container that is sized to be slidable within at least a portion of the secondary storage container, so that said tertiary storage container is telescopingly nested within said secondary storage container.

7. An expandable storage holder for storing implements inserted therein, comprising:

a primary storage container having at least two spaced apart surfaces, each of said surfaces having a plurality of aligned openings formed therein, a secondary storage container having at least two spaced apart surfaces, each of said surfaces having a plurality of aligned openings formed therein, said secondary storage container being movably received within said primary storage container between a nested position wherein said secondary storage container is at least substantially located within said primary storage container and an extended position wherein said secondary storage container extends outwardly from said primary storage container, said openings in said at least two surfaces of said primary storage container and said at least two surfaces of said secondary storage container being oriented such that an implement inserted into said expandable storage holder passes through at least two spaced apart openings, wherein the primary storage container and secondary storage containers are inclined at an angle with respect to the horizontal so that the upper portion of the primary storage container faces a user.

8. An expandable storage holder for storing implements inserted therein, comprising:

a primary storage container having at least two spaced apart surfaces, each of said surfaces having a plurality of aligned openings formed therein, a secondary storage container having at least two spaced apart surfaces, each of said surfaces having a plurality of aligned openings formed therein, said secondary storage container being movably received within said primary storage container between a nested position wherein said secondary storage container is at least substantially located within said primary storage container and an extended position wherein said secondary storage container extends outwardly from said primary storage container, said openings in said at least two surfaces of said primary storage container and said at least two surfaces of said secondary storage container being oriented such that an implement inserted into said expandable storage holder passes through at least two spaced apart openings, wherein the angle of inclination ranges from approximately 30 to 50 degrees, wherein the primary storage container and secondary storage containers are included at an angle with respect to the horizontal so that the upper portion of the primary storage container faces a user.

* * * * *